US010909959B2

(12) United States Patent
Gill

(10) Patent No.: US 10,909,959 B2
(45) Date of Patent: Feb. 2, 2021

(54) SYSTEMS AND METHODS FOR ACTIVE CROSSTALK DETECTION IN AN ELECTRONIC PERCUSSION INSTRUMENT

(71) Applicant: inMusic Brands, Inc., Cumberland, RI (US)

(72) Inventor: David C. Gill, Lincoln, RI (US)

(73) Assignee: INMUSIC BRANDS, INC., Cumberland, RI (US)

( * ) Notice: Subject to any disclaimer, the term of this patent is extended or adjusted under 35 U.S.C. 154(b) by 0 days.

(21) Appl. No.: 16/422,936

(22) Filed: May 24, 2019

(65) Prior Publication Data

US 2019/0362697 A1 Nov. 28, 2019

Related U.S. Application Data

(60) Provisional application No. 62/676,178, filed on May 24, 2018.

(51) Int. Cl.
*G10H 3/14* (2006.01)

(52) U.S. Cl.
CPC ..... *G10H 3/146* (2013.01); *G10H 2220/525* (2013.01)

(58) Field of Classification Search
CPC ..... G10H 3/146; G10H 3/12; G10H 1/14; G10H 7/008; G10H 3/143; G10H 2210/281; G10H 2250/641; G10H 2250/235; G10H 2210/041; G10H 2220/091; G10H 2210/051; G10H 2250/311; G10H 2230/281; G10H 2220/525; G10H 2250/435; G01H 11/02; G01H 11/08; G01H 11/00; G01H 1/00; G10D 13/024
USPC ..... 84/691
See application file for complete search history.

(56) References Cited

U.S. PATENT DOCUMENTS

| | | | | |
|---|---|---|---|---|
| 7,408,109 | B1 * | 8/2008 | Freitas | G10H 3/12 84/687 |
| 7,473,840 | B2 * | 1/2009 | Arimoto | G10H 1/06 84/615 |
| 8,648,243 | B2 * | 2/2014 | Susami | G10H 1/0008 84/621 |
| 9,263,020 | B2 * | 2/2016 | Takasaki | G10H 3/146 |
| 10,171,901 | B2 * | 1/2019 | Takehisa | H04R 1/08 |
| 2005/0150366 | A1 * | 7/2005 | Susami | G10H 3/146 84/735 |
| 2005/0257671 | A1 * | 11/2005 | Aimi | G10H 3/146 84/735 |
| 2008/0034946 | A1 * | 2/2008 | Aimi | G10H 3/146 84/604 |
| 2013/0180386 | A1 * | 7/2013 | Susami | G10H 1/0008 84/621 |
| 2014/0208926 | A1 * | 7/2014 | Shepherd | G10D 13/021 84/730 |

(Continued)

*Primary Examiner* — Jeffrey Donels
(74) *Attorney, Agent, or Firm* — Burns & Levinson, LLP

(57) ABSTRACT

An electronic drum with active crosstalk detection includes a first vibration transducer configured to generate a first signal in response to a strike to the electronic drum, and a second vibration transducer configured to generate a second signal in response to vibrations in a mount coupled to the electronic drum. A circuit compares an amplitude of the first signal and an amplitude of the second signal within a predetermined time, and determines whether the signal was generated by crosstalk or an actual drum hit based on various criteria.

15 Claims, 5 Drawing Sheets

(56) References Cited

U.S. PATENT DOCUMENTS

| | | | | |
|---|---|---|---|---|
| 2014/0216234 | A1* | 8/2014 | Wei | G10D 13/024<br>84/723 |
| 2014/0301589 | A1* | 10/2014 | Greenwood | H04R 1/46<br>381/361 |
| 2016/0093278 | A1* | 3/2016 | Esparza | G10H 3/143<br>84/615 |
| 2016/0225361 | A1* | 8/2016 | Muzzio | G10H 3/14 |
| 2018/0219638 | A1* | 8/2018 | Arimoto | H04H 60/04 |
| 2019/0259361 | A1* | 8/2019 | Esparza | G01H 1/00 |

* cited by examiner

SYSTEMS AND METHODS FOR ACTIVE CROSSTALK DETECTION IN AN ELECTRONIC PERCUSSION INSTRUMENT

PRIORITY

This application claims priority to U.S. Provisional Application No. 62/676,178 filed May 24, 2018, the disclosure of which is hereby incorporated by reference in its entirety.

TECHNICAL FIELD

The present disclosure generally relates to systems and methods for active crosstalk detection in an electronic percussion instrument.

The following detailed descriptions are exemplary and explanatory only, and the invention is not limited to these illustrative embodiments.

BACKGROUND

Musicians use electronic percussion instruments (e.g., electronic drums) to create one or more sounds or sound data by generating an electrical signal. The electrical-signal generation may be initiated by, for example, striking a playing surface or rim of a drumhead on an electronic drum or of an electronic cymbal. The drumhead surface or rim may be coupled to an electromechanical transducer that generates or modifies electrical signals in response to vibrations (e.g., piezoelectric sensor, force-sensing resistor, or strain gauge).

The electronic drums may be positioned relative to the musician in such a manner as to facilitate comfortable playing. The electronic drums may be held in their respective positions by affixing them to one or more mounts or stands. When multiple electronic drums are attached to the same mount, mechanical vibrations may travel from one electronic drum to another through the mount. In such cases, an electromechanical transducer may detect vibrations in an electronic drum the musician did not strike and generate an electrical signal. The module may receive the erroneously generated electrical signal and generate a sound or sound data associated with the electronic drum that was not struck (errant vibrations and noise that enters the drum). The striking of one electronic drum, drum shell, symbol, high hat, or other apparatus which causes a signal to be generated that is associated with another drum may be referred to as "crosstalk."

Therefore, there is a need for improved methods and systems for actively detecting crosstalk in an electronic percussion instrument.

SUMMARY

One illustrative aspect of the present disclosure is directed to a system for active crosswalk detection. The system for active crosswalk detection may include a first vibration transducer configured to generate a first signal in response to a strike to the electronic drum and a second vibration transducer configured to generate a second signal in response to vibrations in a mount coupled to the electronic drum. The system may further include one or more memory devices storing instructions and one or more processors. The processor receives the first signal from the first vibration transducer and the second signal from the second vibration transducer. The processor may further detect an amplitude of the first signal and an amplitude of the second signal within a predetermined time, compare the amplitude of the first signal to the amplitude of the second signal, and generate a third signal indicating a strike occurred to the electronic drum based on the comparison.

Another illustrative aspect of the present disclosure is directed to a non-transitory computer-readable medium for storing instructions executable by a processor to actively detect crosstalk in an electronic drum according to a method. The electronic drum includes a first vibration transducer configured to generate a first signal and a second vibration transducer configured to generate a second signal. The method comprises receiving the first signal from the first vibration transducer and the second signal from the second vibration transducer. The method further comprises detecting an amplitude of the first signal and an amplitude of the second signal within a predetermined time, comparing the amplitude of the first signal to the amplitude of the second signal, and generating a third signal indicating a strike occurred to the electronic drum based on the comparison.

Yet another illustrative aspect of the present disclosure is directed to a system for active crosswalk detection. The system for active crosswalk detection may include a first vibration transducer configured to generate a first signal in response to a strike to the electronic drum, a second vibration transducer configured to generate a second signal in response to vibrations in a mount coupled to the electronic drum, and a third vibration transducer configured to generate a third signal in response to a strike to a drumhead's rim. The system may further include one or more memory devices storing instructions and one or more processors. The processor receives the first signal from the first vibration transducer, the second signal from the second vibration transducer, and the third signal from the third vibration transducer. The processor further detects an amplitude of the first signal, an amplitude of the second signal, and an amplitude of the third signal within a predetermined time. The processor further measures time differences from the first signal generation to the second signal generation and the third signal generation. The processor further measures time between peaks, valleys, or other points in the second signal and the third signal, wherein both signals are oscillating. The processor compares the detected amplitudes, measure time differences, and the measured the time to generate a fourth signal indicating a strike occurred to the electronic drum.

The invention is not limited to the foregoing illustrative embodiments and other systems, methods, and devices are also disclosed herein.

DETAILED DESCRIPTION

Figure 1:
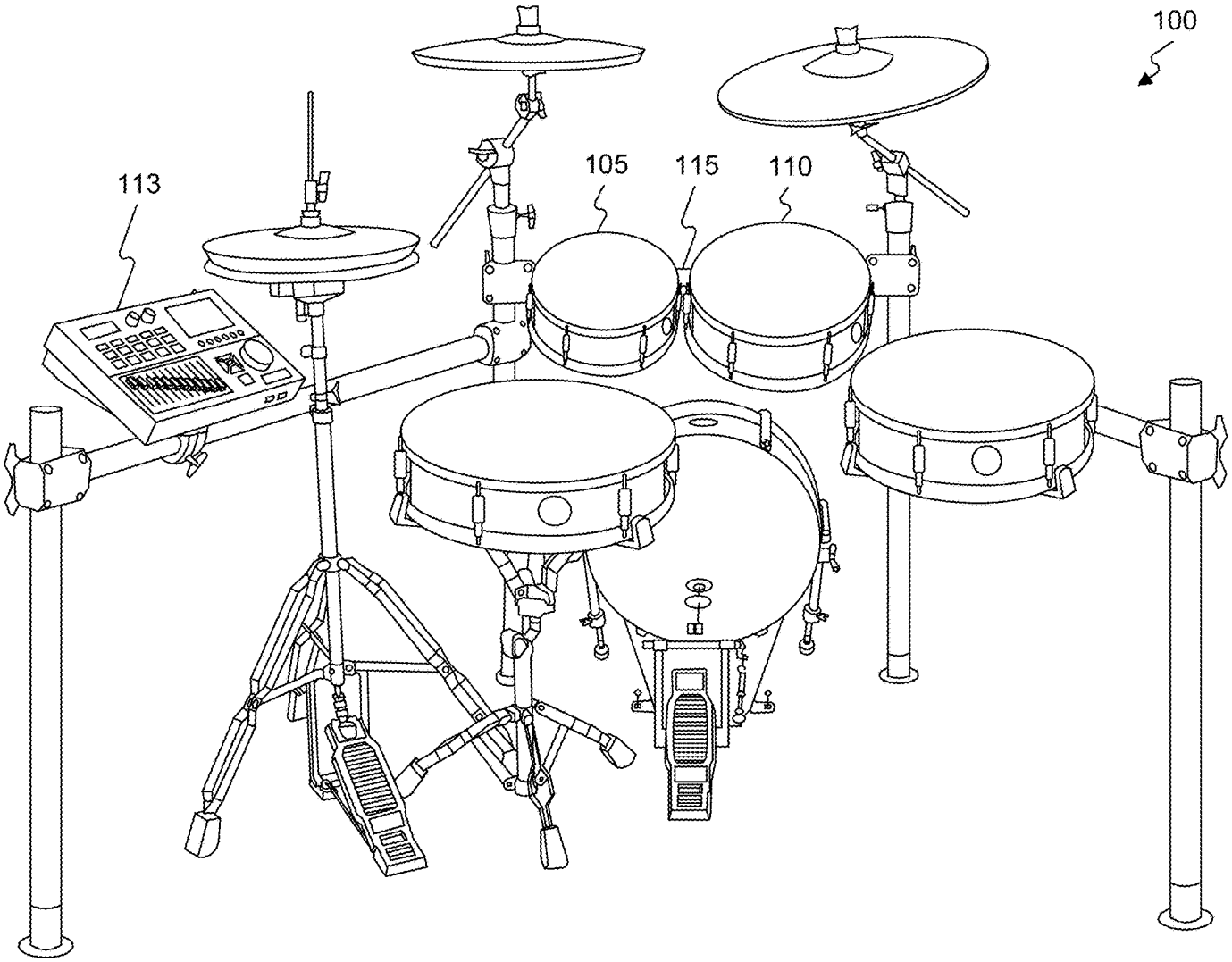
FIG. 1 shows an illustrative embodiment of an electronic drum kit, consistent with the present invention.

The following detailed description refers to the accompanying drawings. Wherever possible, the same reference numbers are used in the drawings and the following description to refer to the same or similar parts. While several illustrative embodiments are described herein, modifications, adaptations and other implementations are possible. For example, substitutions, additions, or modifications may be made to the components and steps illustrated in the drawings, and the illustrative methods described herein may be modified by substituting, reordering, removing, or adding steps to the disclosed methods. Accordingly, the following detailed description is not limited to the disclosed embodiments and examples. Instead, the proper scope of the invention is defined by the appended claims.

The present disclosure is directed to a system and method for actively detecting crosstalk for use with an electronic instrument. The disclosure provides innovative technical features that connect an additional piezo element directly to a drum mount and send a signal to the microprocessor located inside the drumhead from the additional transducer. The signal allows the processor to actively detect the difference between strikes to the drumhead and vibrations created by playing other drums. For example, the present disclosure enables microprocessors inside the drumhead to analyze signals received from transducers implemented on a drumhead and a drum mount and detect a crosstalk. This enables a main drum module to learn the trigger detecting and sensing while effectively dealing with the noise at the source.

FIG. 1 shows an illustrative embodiment of an electronic drum kit 100. Electronic drum kit 100 comprises multiple electronic drums, such as electronic drums 105 and 110. Electronic drums 105 and 110 may transmit information to and/or from module 113. Electronic drums 105 and 110 are affixed to mount 115 using, for example, a mechanical coupling mechanism (discussed below with respect to FIG. 2). Mount 115 may suspend or otherwise position electronic drums 105 and 110 in such a manner as to facilitate comfortable playing for a musician. In some embodiments, striking electronic drum 105 may cause vibrations from electronic drum 105 to traverse through mount 115 to an electromechanical transducer within drum 110. Without an active crosstalk detection system or method, this crosstalk may cause electronic drum 110 to transmit a signal to module 113, resulting in module 113 generating a sound or sound data associated with electronic drum 110 even though electronic drum 110 was not struck.

Figure 2:
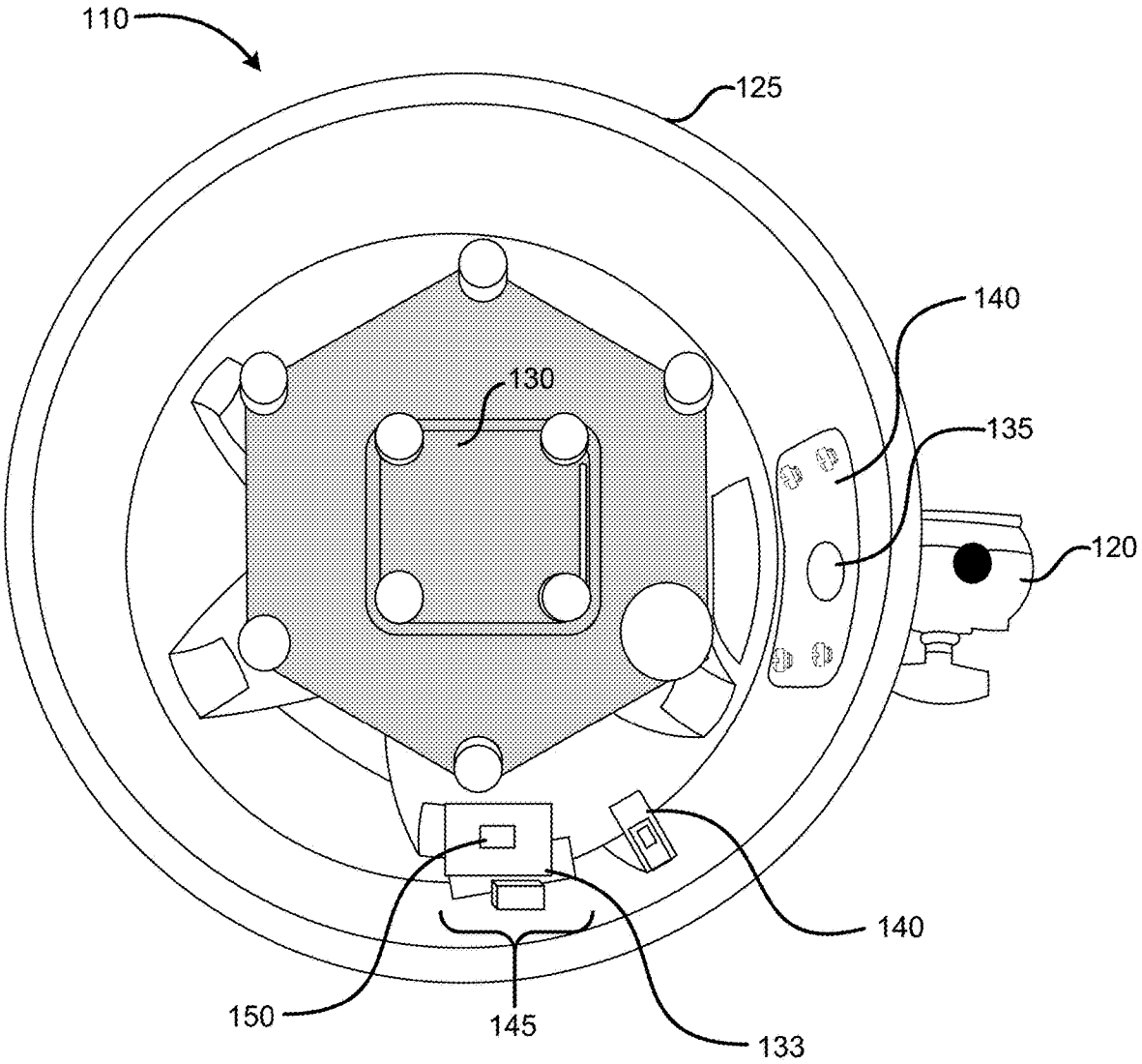
FIG. 2 shows a top plain view of an illustrative embodiment of electronic drum with its drumhead removed.

FIG. 2 shows a top plain view of an illustrative embodiment of electronic drum 110 with its drumhead removed. Electronic drum 110 may be secured to mount 115 with a mechanical coupling device, such as mount bracket 120. Vibrations from mount 115 may travel through mount bracket 120 to shell 125 of electronic drum 110. Vibrations may travel from shell 125 to an electromechanical transducer beneath plate 130. These vibrations may have originated with a strike to a drum other than electronic drum 110 (e.g., a strike to electronic drum 105). In this case, to prevent a signal from being sent from electronic drum 110 to module 113 that generates a sound or sound data associated with electronic drum 110, electronic drum 110 may comprise a circuit 133 for facilitating active crosstalk detection and a mount transducer 135. Mount transducer 135 is coupled to a mount plate 140, which in turn is coupled to mount bracket 120. In some embodiments, mount transducer 135 may be coupled to shell 125 or other portion of electronic drum 110 where vibrations from mount 115 may be readily. Circuit 133 is coupled to the electromechanical transducer under plate 130 and mount transducer 135.

Circuit 133 is implemented on a printed circuit board 145. Circuit 133 comprises comprise a microprocessor 150. Circuit 133 may receive power from an external source, such as a dedicated power supply (not shown) or module 113. Power is provided to circuit 133 via connector 140. Connector 140 may be, for example, a Universal Serial Bus connector or an ethernet RJ45 connector.

Figure 3:
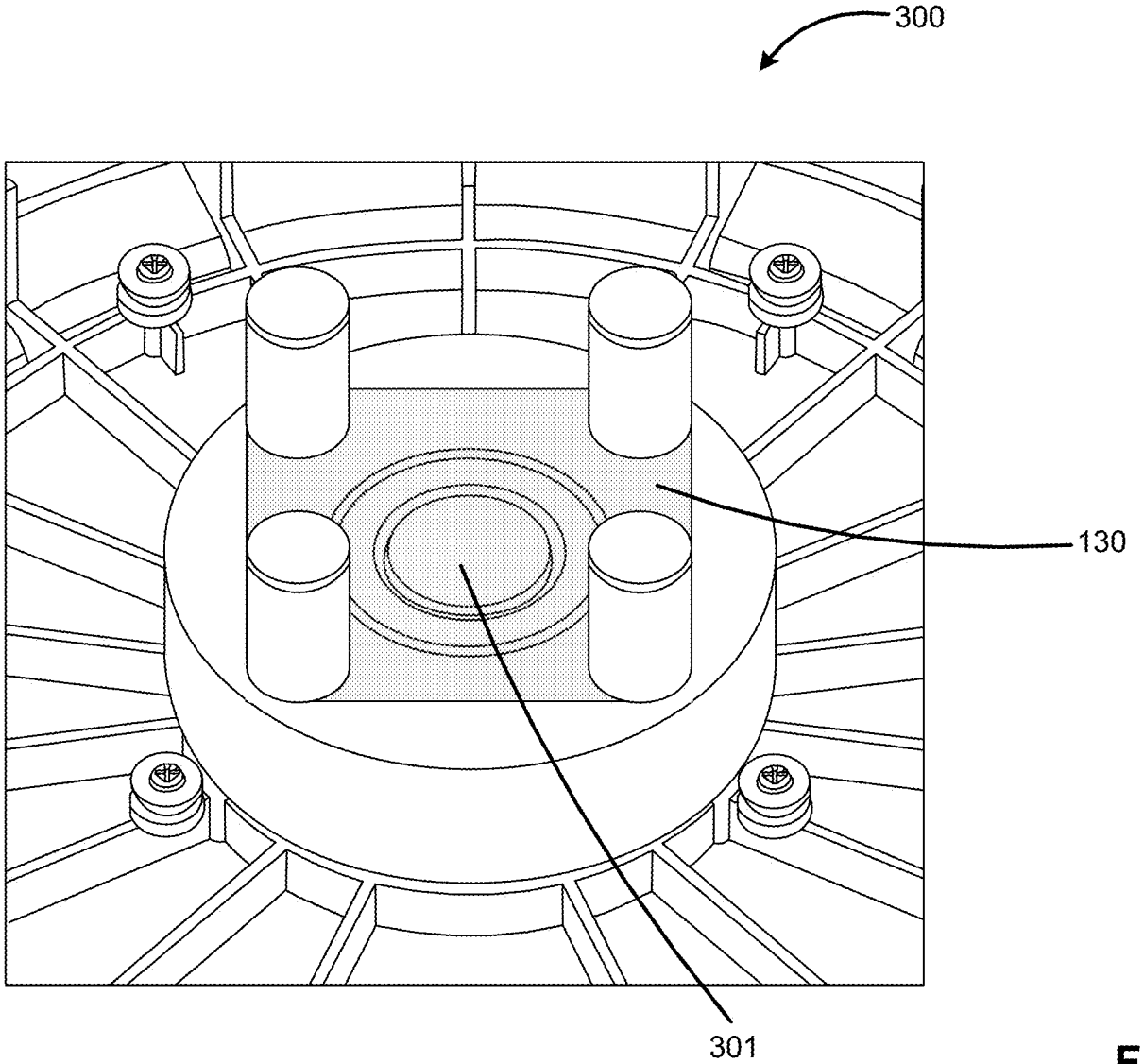
FIG. 3 shows an exemplary interior of electronic drum.
Figure 4:
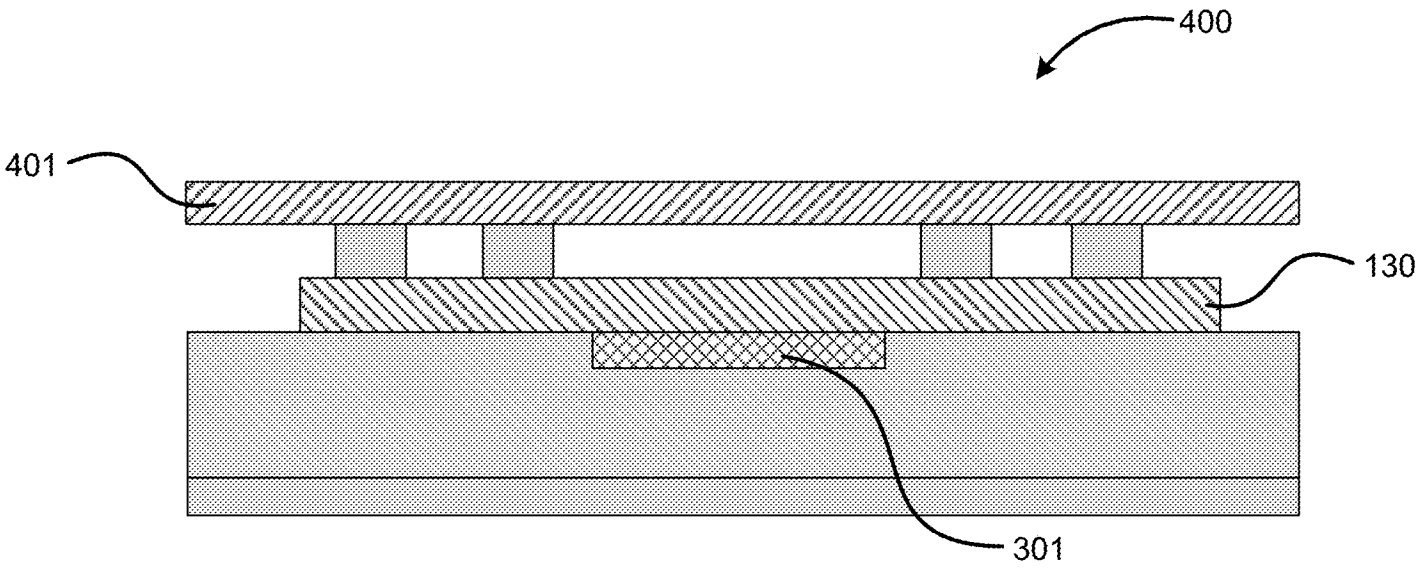
FIG. 4 shows a diagram illustrating an exemplary cross-sectional view of interior of an electronic drum.

FIGS. 3-4 provide an illustrative interior design of electronic drum 110. FIG. 3 shows an exemplary interior 300 of electronic drum 110. The interior 300 may include the electromechanical transducer 301 under plate 130. FIG. 4 shows a diagram illustrating an exemplary cross-sectional view 400 of interior of an electronic drum 110. Electronic drum 110 may be comprised of playing surface 401, plate 130, and electromechanical transducer 301. Plate 130 may transfer vibrations, induced by force received on playing surface 401, to electromechanical transducer 301.

The electromechanical transducer 301 may generate different electrical signals based on the force received by a playing surface 401 of electronic drum 110. For example, the amplitude of a first electrical signal may be greater than the amplitude of a second electrical signal, if the force corresponding to the first electrical signal is greater than the force corresponding to the second electrical signal.

Mount plate 140 may vibrate and cause mount transducer 135 when mount bracket 120 receives vibrations from mount 115. Even though the vibration of mount bracket 120 may cause vibration of the electromechanical transducer 301 under plate 130, circuit 133 may determine that this transducer's 301 vibrations are due to crosstalk rather than due to a strike to electronic drum 110. The circuit 133 may determine that the vibrations are due to crosstalk when it receives signals from electromechanical transducer 301 and mount transducer 135 at the same time or within a predetermined time (e.g., within 2 milliseconds). If circuit 133 determines that the signal from the electromechanical transducer 301 was generated in response to a strike to electronic drum 110, circuit 133 may transmit a signal to module 113 to generate a sound or sound data associated with electronic drum 110. If circuit 133 determines that the signal from the electromechanical transducer 301 was generated in response to crosstalk (e.g., a strike to a drum other than electronic drum 110), the circuit will prevent a signal from being sent to module 113 that would otherwise cause module 113 to generate a sound or sound data associated with electronic drum 110.

In some embodiments, circuit 133 may analyze the magnitude and/or timing of the signals from mount transducer 135 and the electromechanical transducer 301 to determine whether the signal from the electromechanical transducer 301 resulted from a strike to electronic drum 110. For example, a high-amplitude signal from mount transducer 135 (e.g., having an amplitude 10 Volts) followed by a lower-amplitude signal from the electromechanical transducer 301 (e.g., having an amplitude of 2 Volts) within a predetermined length of time (e.g., 1 millisecond) indicates that the signal generated by transducer 301 was not generated by a strike to the head of electronic drum 110 but rather, for example, from a strike to an adjacent drum or other apparatus. Circuit 133 would then not send a signal to the module 113 in response to the crosstalk signal generated by transducer 301 and the module would not generate sound corresponding to a strike to the drum 110. In some embodiments, circuit 133 may perform this determination with respect to signals from an electromechanical transducer (discussed below with respect to FIG. 5) for detecting strikes to the rim of electronic drum 110 instead or in addition to signals from the electromechanical transducer 301. In some embodiments, there may be multiple instances of circuit 133 for making such a determination for signals from multiple transducers within electronic drum 110. When different circuits are used for different transducers, the circuits may be configured to perform the analysis in different manners from one another. When the same circuit is used for different transducers, the circuit may be configured to perform the analysis in at least two different manners for at least two of the transducers, respectively.

In some embodiments, circuit 133 may analyze the envelope of one or more signals received from mount transducer 135 and/or the electromechanical transducer 301 to determine whether the signal from the electromechanical transducer 301 resulted from a strike to electronic drum 110. For example, if the signals from one of the transducers is oscillating, circuit 133 may measure the time between peaks, valleys, or other points in the oscillating signal. In an exemplary embodiment, if the time between peaks in the oscillating signal from mount transducer 135 is below a predefined duration (e.g., 3 milliseconds), circuit 133 may determine that a signal from the electromechanical transducer 301 was generated in response to crosstalk. In an exemplary embodiment, if the time between peaks in the oscillating signal from mount transducer 135 is above a predefined duration (e.g., 5 milliseconds), circuit 133 may determine that a signal from the electromechanical transducer 301 was generated in response to crosstalk.

In some embodiments, circuit 133 may analyze at least one of the timing, the amplitude, or the envelope of the at least one signal from mount transducer 135 and/or the electromechanical transducer 301 to determine whether the signal from the electromechanical transducer 301 resulted from a strike to electronic drum 110.

In some embodiments, circuit 133 may facilitate performing a calibration routine whereby circuit 133 is trained to determine whether the signal from the electromechanical transducer 301 resulted from a strike to electronic drum 110. For example, a user may strike electronic drum 105 while circuit 133 is in a training mode, and circuit 133 will analyze at least one of the timing, the amplitude, or the envelope of the at least one signal from mount transducer 135 and/or the electromechanical transducer 301. In some embodiments, this process may be repeated multiple times. Once trained, circuit 133 may compare signals received from at least one transducer during a performance to the data analyzed during the training routing (e.g., training data) to determine whether the signal generated by the electromechanical transducer 301 during a performance resulted from a strike to electronic drum 110. In some embodiments, a user may strike electronic drum 110 instead or in addition to electronic drum 105 to train circuit 133. In some embodiments, circuit 133 may rely on the analysis from the training routine if a certain condition is met (e.g., if another analysis does not yield a satisfactory result or a result with a sufficient confidence).

A benefit of having a dedicated circuit 133 perform the analysis described above instead of using a circuit with a processor of module 113 perform the analysis is relieving the one or more processors in module 113 from performing these computations. Performing these computations in module 113 may create an audible delay at least because module 113 may be performing these computations for multiple electronic drums in electronic drum kit 100. Performing these computations in module 113 may create an audible delay that varies in duration over the course of a performance. Such variation may be particularly undesirable to musicians using electronic drum kit 100 to play in time or synchronize with other musicians or metronomes.

Having a dedicated circuit such as circuit 133 closer to transducers within electronic drum 110 than module 113 may reduce the audible delay by reducing the propagation delay of an analog signal from electronic drum 110 to module 113. Circuit 133 may communicate necessary information to module 113 using one or more digital protocols instead or in addition to analog signals. Using one or more digital protocols to transmit information to module 113 may increase the speed and accuracy of the communication between the electronic drums and module 113.

Figure 5:
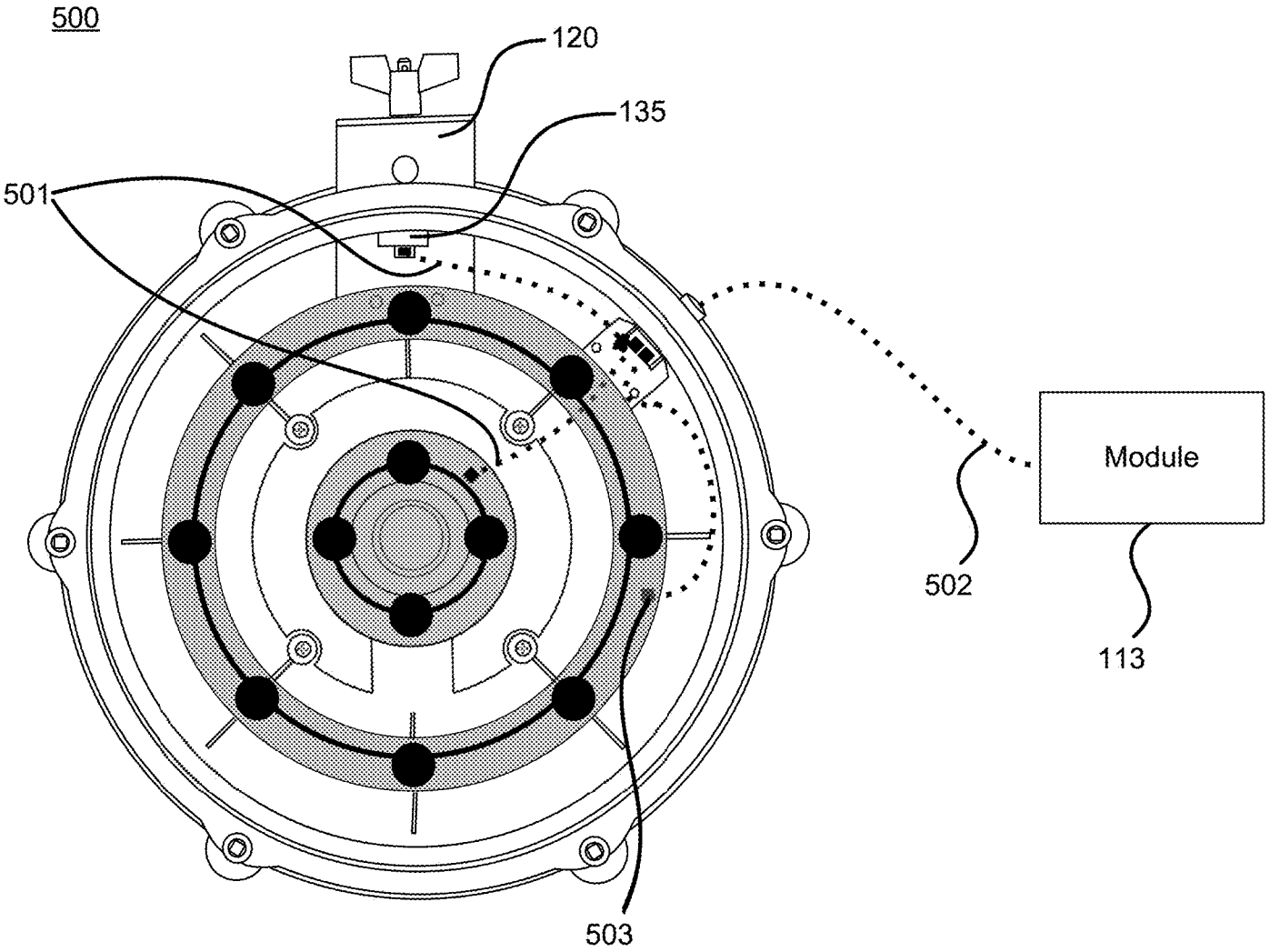
FIG. 5 shows exemplary connections between transducers and circuit, electronic drum and module, and an additional electromechanical transducer inside the electronic drum.

FIG. 5 shows exemplary connections between transducers and circuit 133, electronic drum 110 and module 113, and an additional electromechanical transducer 503. Electrical wires 501 may connect mount transducer 135 and electromechanical transducer 301 to the circuit 133, thereby transmitting signals from the transducers to the circuit 133. For example, electric wire 501 may transmit a signal from transducer 135, which is generated from vibrations on mount 120, to circuit 133. Standard tip-ring cable 502 may connect electronic drum 110 to module 113, thereby transmitting signals from the electronic drum 110 to the module 113. For example, standard tip-ring cable 502 may transmit a signal from electronic drum 110, the signal generated after analyzing signals received from transducer 135 and electromechanical transducer 301, to circuit 133. Additional electromechanical transducer 503 may detect strikes close to the rim of electronic drum 110 as described above in respect to FIG. 3-4. For example, circuit 133 may analyze signals from mount transducer 135, electromechanical transducer 301, and additional mechanical transducer 503 to generate signals to module 113. While FIG. 5 is described with respect to additional electromechanical transducer 503, one of ordinary skill in the art will recognize that transducer 503 may be replaced with a circuit which may receive signals from multiple transducers (not pictured) and analyze the received signals in different manner from other circuits.

Having a dedicated circuit such as circuit 133 perform crosstalk detection for one or more drums may decrease the audible delay. In an embodiment, a dedicated circuit, such as circuit 133, may be housed in module 113. For example, transducers in electronic drum 110 may be coupled to circuit 133 within module 113. Because standard tip-ring-sleeve cables may carry a signal from a drumhead-surface transducer to module 113 over one of the tip or ring and a signal from the drumhead-rim transducer over the other of the tip or the ring, transmitting a signal from mount transducer 135 to module 113 may require another type of cable or transmission mechanism with an additional channel for signal transmission. Having the analysis performed by circuit 133 outside of module 113 may permit a standard tip-ring-sleeve cable connection between electronic drum 110 and module 113.

While embodiments of exemplary systems and methods for active crosstalk detection in an electronic percussion instrument have been presented, it is to be understood that similar systems and methods may be used to effectuate active crosstalk detection in an electronic percussion instrument.

Certain embodiments of the present disclosure can be implemented as software on a general-purpose computer or on another device.

The foregoing description has been presented for purposes of illustration. It is not exhaustive and is not limited to the precise forms or embodiments disclosed. Modifications and adaptations will be apparent to those skilled in the art from consideration of the specification and practice of the disclosed embodiments.

The features and advantages of the disclosure are apparent from the detailed specification, and thus, it is intended that the appended claims cover all systems and methods falling within the true spirit and scope of the disclosure. As used herein, the indefinite articles "a" and "an" mean "one or more." Similarly, the use of a plural term does not necessarily denote a plurality unless it is unambiguous in the given context. Words such as "and" or "or" mean "and/or" unless specifically directed otherwise. Further, since numerous modifications and variations will readily occur from studying the present disclosure, it is not desired to limit the disclosure to the exact construction and operation illustrated and described, and, accordingly, all suitable modifications and equivalents falling within the scope of the disclosure may be resorted to.

Computer programs, program modules, and code based on the written description of this specification, such as those used by the microcontrollers, are readily within the purview of a software developer. The computer programs, program modules, or code can be created using a variety of programming techniques. For example, they can be designed in or by means of Java, C, C++, assembly language, or any such programming languages. One or more of such programs, modules, or code can be integrated into a device system or existing communications software. The programs, modules, or code can also be implemented or replicated as firmware or circuit logic.

Another aspect of the disclosure is directed to a non-transitory computer-readable medium storing instructions which, when executed, cause one or more processors to perform the methods of the disclosure. The computer-readable medium may include volatile or non-volatile, magnetic, semiconductor, tape, optical, removable, non-removable, or other types of computer-readable medium or computer-readable storage devices. For example, the computer-readable medium may be the storage unit or the memory module having the computer instructions stored thereon, as disclosed. In some embodiments, the computer-readable medium may be a disc or a flash drive having the computer instructions stored thereon.

Moreover, while illustrative embodiments have been described herein, the scope of any and all embodiments include equivalent elements, modifications, omissions, combinations (e.g., of aspects across various embodiments), adaptations and/or alterations as would be appreciated by those skilled in the art based on the present disclosure. The limitations in the claims are to be interpreted broadly based on the language employed in the claims and not limited to examples described in the present specification or during the prosecution of the application. The examples are to be construed as non-exclusive. Furthermore, the steps of the disclosed methods may be modified in any manner, including by reordering steps and/or inserting or deleting steps. It is intended, therefore, that the specification and examples be considered as illustrative only, with a true scope and spirit being indicated by the following claims and their full scope of equivalents.

What is claimed is:

1. An electronic drum, comprising:

a first vibration transducer configured to generate a first signal in response to a strike to the electronic drum;

a second vibration transducer configured to generate a second signal in response to vibrations in a mount coupled to the electronic drum; and a circuit for comparing the first and second signals and determining whether the first signal is generated from a strike on the electronic drum or generated from a strike from an adjacent drum, wherein the circuit is adapted to analyze a difference between an amplitude of the first signal and an amplitude of the second signal within a predetermined length of time.

2. The electronic drum of claim 1, wherein the circuit is adapted to determine that the first signal is not in response to a strike to the electronic drum when the amplitude of the first signal is less than the amplitude of the second signal.

3. The electronic drum of claim 1, wherein the circuit is adapted to determine that the first signal was generated after the second signal was generated.

4. The electronic drum of claim 1, wherein the circuit is adapted to determine that the first signal is not in response to a strike to the electronic drum when the first signal is generated less than a predetermined time later than then second signal.

5. The electronic drum of claim 1, wherein the circuit is adapted to run a calibration routine to acquire training data and compare the first signal to the training data.

6. The electronic drum of claim 5, wherein the circuit is adapted to run a calibration routine to acquire training data and compare the first signal to the training data.

7. The electronic drum of claim 1, wherein the drum includes a shell, and the circuit is external to the shell.

8. The electronic drum of claim 1, wherein the drum includes a shell, and the circuit is mounted inside the shell.

9. The electronic drum of claim 1, wherein the drum includes a shell, and the second vibration transducer is mounted to the shell.

10. A method for detecting a drum strike on an electronic drum comprising the steps of:

generating a first signal from a first vibration transducer for detecting drum strikes on the electronic drum;

generating a second signal from a second vibration transducer mounted in the electronic drum;

comparing the first and second signals by analyzing a difference between an amplitude of the first signal and an amplitude of the second signal within a predetermined length of time; and determining whether the first signal is a strike on the electronic drum based on the comparison of the two signals.

11. The method of claim 10, wherein the comparing step includes determining whether the amplitude of the first signal is less than the amplitude of the second signal.

12. The method of claim 10, wherein the comparing step includes determining whether that the first signal was generated after the second signal was generated.

13. The method of claim 10, wherein the determining step includes determining that the first signal is not in response to a strike to the electronic drum when the first signal is generated less than a predetermined time later than then second signal.

14. The method of claim 10, further comprising running a calibration routine to acquire training data and comparing the first signal to the training data.

15. The method of claim 14, further comprising running a calibration routine to acquire training data and comparing the second signal to the training data.

* * * * *